US009364070B2

(12) United States Patent
Gutberlet

(10) Patent No.: US 9,364,070 B2
(45) Date of Patent: Jun. 14, 2016

(54) APPLICATOR UNIT FOR A COSMETIC UNIT AND COSMETIC UNIT WITH AN APPLICATOR UNIT OF THIS TYPE

(71) Applicant: h & m gutberlet gmbh, Nürnberg (DE)

(72) Inventor: Detlev Gutberlet, Altdorf (DE)

(73) Assignee: H & M GUTBERLET GMBH, Nuremberg (DE)

( * ) Notice: Subject to any disclaimer, the term of this patent is extended or adjusted under 35 U.S.C. 154(b) by 269 days.

(21) Appl. No.: 13/902,063

(22) Filed: May 24, 2013

(65) Prior Publication Data

US 2013/0315645 A1 Nov. 28, 2013

(30) Foreign Application Priority Data

May 25, 2012 (DE) ..... 10 2012 208 918

(51) Int. Cl.

| | |
|---|---|
| ***A45D 40/10*** | (2006.01) |
| ***A45D 40/20*** | (2006.01) |
| ***A45D 33/36*** | (2006.01) |
| ***A45D 34/04*** | (2006.01) |
| ***A45D 40/26*** | (2006.01) |
| ***A45D 40/28*** | (2006.01) |

(52) U.S. Cl.

CPC ..... *A45D 40/20* (2013.01); *A45D 33/36* (2013.01); *A45D 34/04* (2013.01); *A45D 40/26* (2013.01); *A45D 40/28* (2013.01); *A45D 34/045* (2013.01); *A45D 40/10* (2013.01); *A45D 2200/1009* (2013.01); *A45D 2200/1018* (2013.01)

(58) Field of Classification Search

CPC .. A45D 40/10; A45D 40/20; A45D 2040/207

USPC ..... 401/81, 88, 98, 127, 266, 278

See application file for complete search history.

(56) References Cited

U.S. PATENT DOCUMENTS

| | | | | |
|---|---|---|---|---|
| 2,486,960 | A * | 11/1949 | Mesh et al. | 401/53 |
| 3,837,749 | A | 9/1974 | Spatz | |
| 5,040,914 | A * | 8/1991 | Fitjer | 401/127 |
| 5,230,577 | A * | 7/1993 | Cox et al. | 401/68 |
| 5,832,942 | A | 11/1998 | Gutberlet | |
| 6,341,912 | B1 | 1/2002 | Gueret | |
| 6,371,673 | B1 * | 4/2002 | Gueret | 401/31 |
| 7,503,717 | B2 * | 3/2009 | Gutberlet | 401/66 |
| 2003/0180082 | A1 | 9/2003 | Gutberlet | |

(Continued)

FOREIGN PATENT DOCUMENTS

| | | | |
|---|---|---|---|
| DE | 296 08 964 | U1 | 8/1996 |
| DE | 29608964 | U1 | 8/1996 |

(Continued)

OTHER PUBLICATIONS

EPO search report dated Sep. 17, 2013, in corresponding European application 1316605.9.

(Continued)

*Primary Examiner* — Jennifer C Chiang

(74) *Attorney, Agent, or Firm* — Browdy and Neimark, PLLC

(57) ABSTRACT

An applicator unit for a cosmetic unit comprises a substantially cylindrical applicator support body with an applicator longitudinal axis and an applicator arranged on an applicator head of the applicator support body to apply a cosmetic product, the applicator unit being configured in one piece.

25 Claims, 7 Drawing Sheets

(56) References Cited

U.S. PATENT DOCUMENTS

| | | | | |
|---|---|---|---|---|
| 2004/0120751 | A1 | 6/2004 | Gueret | |
| 2005/0015911 | A1* | 1/2005 | Harty | 15/244.3 |
| 2011/0282243 | A1 | 11/2011 | Nakatani | |

FOREIGN PATENT DOCUMENTS

| | | | |
|---|---|---|---|
| DE | 10102219 | A1 | 7/2002 |
| DE | 20204670 | U1 | 7/2002 |
| DE | 60302954 | T2 | 8/2006 |
| DE | 602004007435 | T2 | 3/2008 |
| DE | 20 2010 014467 | U1 | 12/2010 |
| JP | 2000325140 | A | 11/2000 |

OTHER PUBLICATIONS

European search report dated Sep. 11, 2015, in corresponding European application 2,666,384.

* cited by examiner

APPLICATOR UNIT FOR A COSMETIC UNIT AND COSMETIC UNIT WITH AN APPLICATOR UNIT OF THIS TYPE

CROSS-REFERENCES TO RELATED APPLICATIONS

This application claims the priority of German Patent Application, Serial No. 10 2012 208 918.7, filed May 25, 2012, pursuant to 35 U.S.C. 119(a)-(d), the content of which is incorporated herein by reference in its entirety as if fully set forth herein.

FIELD OF THE INVENTION

The invention relates to an applicator unit for a cosmetic unit and a cosmetic unit with an applicator unit of this type.

BACKGROUND OF THE INVENTION

An applicator for liquid or pasty media, in particular decorative cosmetics such as mascara, is known from DE 101 02 219 A1. A mascara brush of this type has a core, on which a carrier sleeve is held. The production of a mascara brush of this type is complicated and laborious.

A device for storing and applying a cosmetic product is known from DE 60 2004 007 435 T2. The device comprises a holder and a band, which is fastened to the holder and on which a large number of application elements are provided. The production of a device of this type is laborious and complicated.

A cosmetic unit with an applicator for applying a cosmetic product is known from DE 202 04670 U1. The applicator is produced from foam and held in a sleeve-like applicator-holder. The assembly of the applicator with the applicator holder and, in particular, a subsequent assembly of the applicator with the applicator holder in a cosmetic unit are complicated.

SUMMARY OF THE INVENTION

The present invention is based on an object of developing an applicator for a cosmetic unit in such a way that the production of the applicator is simplified, wherein, in particular, the suitability of the applicator for applying a cosmetic product is not impaired.

This object is achieved according to the invention by an applicator unit for a cosmetic unit comprising a. a substantially cylindrical applicator support body with an applicator longitudinal axis, b. an applicator arranged on an applicator head of the applicator support body for applying a cosmetic product, wherein the applicator unit is configured in one piece, and by a cosmetic unit with a. a housing, b. an applicator unit according to any one of the preceding claims arranged, at least in portions, within the housing.

According to the invention, it was recognized that an applicator unit for a cosmetic unit, in particular for a cosmetic pencil, is configured in one piece. "One piece" in the sense of the invention means that the components of the applicator unit, in other words the applicator support body and the applicator arranged on the applicator head are rigidly, in particular non-releasably, connected to one another. In particular, the applicator support body and the applicator are connected to one another with a positive material joint. A positive material joint of this type between the applicator support body and applicator is, for example, provided by a chemical connection and/or by a physical adhesive connection. It is thereby ensured that the applicator is reliably and, in particular permanently, connected to the applicator support body. Furthermore, the method for producing the applicator unit is simplified. An applicator for applying a cosmetic product is provided on an applicator head of an applicator support body. Since the applicator unit is configured in one piece, all the functions, which the applicator unit fulfils, are advantageously combined. The applicator unit is a one-piece, integrally produced product. The applicator unit allows a functional integration. The number of individual parts is reduced. In particular, an assembly of a plurality of components with one another is not necessary. In particular, it is not necessary to assemble a comparatively soft foam applicator in a comparatively hard applicator holder. The applicator unit according to the invention is robust. The applicator unit can be produced in an uncomplicated and economical manner. In particular, an applicator unit of the present invention is configured in such a way that it can be used in already existing and commercially available cosmetic pencils or can be combined therewith.

An applicator unit comprising a stop element to apply a force to the applicator support body, allows an advantageous use of the applicator unit, in particular in a cosmetic pencil. For example, a spring-loaded actuation of the applicator support body is possible. A stop element to apply a force to the applicator support body, in particular along an applicator longitudinal axis of the applicator support body, is provided on the applicator support body at one end. In particular, further functions are thereby integrated in the applicator unit, namely the application of a force to the applicator support body by means of the stop element and the transmission of the force to the applicator.

An applicator unit, in which the applicator support body is produced from plastics material, which, in particular, has a hardness of at most 80 Shore D, in particular, at most 60 Shore D and in particular of at most 40 Shore D, and in which the material of the applicator support body includes polyethylene and an elastomer, in particular an elastomeric polyester block polymer, in particular a thermoplastic polyester elastomer, has an improved resilience, in particular compared to the applicator holder known from DE 202 04 670 U1, which is produced from a hard plastics material. Since the applicator support body is produced from a material, which has a high resilience, the applicator unit is elastically deformable as a whole, in particular over a great length of the applicator unit. The material has, in particular, polyethylene (PE) and an elastomer. The material may be a polyester elastomer, which is known, for example, under the trademark Hytrel or under the trademark Desmopan. In particular, the material has low density polyethylene (LDPE) with a modulus of elasticity of about 200 $N/min^2$. It is also possible for linear low density polyethylene (LLDPE) with a modulus of elasticity in a range from 60 to 600 $N/mm^2$ to be provided. The application of the cosmetic product, in particular, is improved thereby. During the application, the applicator adapts better together with the applicator support body. Moreover, the applicator support body has adequate stability, which is necessary to allow the application of the cosmetic product. The applicator support body is self-supporting, i.e. it has an inherent rigidity in such a way that it is dimensionally stable under the load of its own weight. In particular, the applicator support body has good mechanical properties and is, in particular, creep-resistant and abrasion-resistant. Furthermore, the applicator support body can be used, in particular, in a large temperature range, in particular between −40° C. and 110° C. The applicator support body has good chemical properties. In particular, it is resistant to hydrocarbon compounds. The applicator support body has good dimensional stability. The applicator support body may, for example, be produced by injection molding, extrusion, extrusion coating, blow molding, fusion casting or rotational casting.

An applicator unit, in which the applicator support body has a full cross-section oriented perpendicular to the applicator longitudinal axis, has an applicator support body with an enhanced stability. In particular, the production of an applicator support body of this type is simplified.

An applicator unit, in which the applicator support body has a hollow cross-section oriented perpendicular to the applicator longitudinal axis, has a lower weight. In addition, the material consumption is reduced in the production of the applicator support body. The production of the applicator support body is economical. Since the applicator support body has a hollow cross-section oriented perpendicular to the applicator longitudinal axis, its flexibility and resilience are additionally improved.

An applicator unit, in which the applicator has a coating in the form of a flocking, allows a particularly uncomplicated integration of the applicator into the applicator unit. A coating in the form of a flocking has a large number, such as, for example, several hundred thousand or several millions, of short-cut fibres. The fibres are, for example, oriented by means of an electrical field and applied perpendicularly to the applicator support body in the region of the applicator head. An adhesive can be used to fasten the fibres on the applicator support body. Depending on the fiber thickness and fiber length, a desired function, look and/or feel of the flocking can be deliberately adjusted. In particular, it is thereby possible to make the applicator in accordance with different user requirements, for example softer or harder. It is also possible, instead of a flocking, to produce a surface for the application of a cosmetic product in the region of the applicator head by means of two-component (2C)-injection molding in one piece with the applicator support body. For example, it is possible to produce the applicator support body from a thermoplastic polyester elastomer (TPC-ET) and to produce the coating injected therewith from polyethylene and/or polypropylene. In particular, the flocking is provided directly on an outer surface of the applicator support body. In particular, the flocking is applied directly to the applicator head. In particular, the provision of a band known from DE 60 2004 007 435 T2 to fasten a flocking to the applicator can thereby be dispensed with. The production of the applicator as a whole and, in particular the application of the flocking to the applicator, is thereby simplified.

An applicator unit, in which the coating has fibres made of polyamide, in particular of PA 6.6, and in which the coating has a flock thickness of at least 1.7 dtex and, in particular, of at least 3.3 dtex, and in which the coating has fibres with a fiber length of at least 0.5 mm, in particular of at least 0.7 mm, in particular of at least 1.0 mm, in particular of at least 2.0 mm and in particular of at least 1.5 mm, has proven to be particularly advantageous with regard to the production of the coating and the practicability for the application of a cosmetic product.

An applicator unit comprising a cross-sectional shape, which is oriented perpendicular to the applicator longitudinal axis and, at least in portions, is configured to be non-round, allows rotation to be prevented about the applicator longitudinal axis in an arrangement in a cosmetic pencil. It is, for example, possible for the stop element to have a non-round cross-sectional shape oriented perpendicular to the applicator longitudinal axis owing to a non-round external contour, such as, for example, a square. This outer, non-round cross-sectional shape corresponds with an inner, also non-round cross-sectional shape of a housing of a cosmetic pencil, in which the applicator unit can be assembled. Accordingly, it is not possible to rotate the applicator unit about the applicator longitudinal axis in the housing of the cosmetic pencil. The handling of the cosmetic pencil and, in particular, the application of the cosmetic product, is thereby improved. It is obviously also possible to select other non-round cross-sectional shapes, such as, for example, a triangular, other four-sided, hexagonal, octagonal or oval cross-sectional shape. It is furthermore possible to provide, on a round cross-sectional shape, radially outwardly directed webs, with respect to the applicator longitudinal axis, or radially inwardly directed grooves, which are in each case oriented parallel to the applicator longitudinal axis. The non-round cross-sectional shape can also be used as a linear guide of the applicator unit along the applicator longitudinal axis in a housing of the cosmetic pencil. It is also possible for the non-round cross-sectional shape to not be provided on the stop element, but on the applicator support body. The non-round cross-sectional shape is used as an anti-rotation device for the applicator unit. The anti-rotation device may extend along the applicator longitudinal axis over a large part of the applicator unit. In particular, the anti-rotation device can, for example, extend over at least 50% of the length of the applicator unit. Alternatively, it is also possible for the anti-rotation device to be on a region of reduced length of, for example, at most 20%, in particular at most 15%, and, in particular at most 10% of the total length along the applicator longitudinal axis of the applicator unit. The freedom in the design of the applicator support body or the applicator unit is thus increased overall. In particular it is not necessary for the applicator support body to have an imperatively substantially cylindrical cross-section that is invariable along the applicator longitudinal axis over a large region. It is possible for the applicator support body to have a conical course in a region outside the anti-rotation device.

An applicator unit, in which the stop element has a non-round cross-sectional shape, allows a particularly advantageous configuration of the anti-rotation device. Since the stop element is preferably used for axial fixing in the housing of the cosmetic pencil, it has an enlarged cross-section compared to the applicator support body. This means that, in particular, the axial holding of the applicator unit in the housing of the cosmetic pencil, on the one hand, and the anti-rotation device of the applicator unit in the housing, on the other hand, are combined on the stop element with a non-round cross-sectional shape. It is, in particular, not necessary to provide a plurality of functional elements on the applicator unit to fulfill the functions mentioned.

An applicator unit, in which the stop element has a sleeve portion and a contact face, comprises a hollow sleeve portion, which, in particular, is configured concentrically with respect to the applicator longitudinal axis and is connected to the applicator support body. In particular, a connecting portion connecting the sleeve portion to the applicator support body has a contact face, which is used to apply a spring element. The contact face is, in particular, oriented perpendicular to the applicator longitudinal axis and is annular. The stop element is bowl-shaped. The stop element, on the one hand, allows a guidance of a compression spring to be arranged therein and, on the other hand, a secure receiving of the compression spring in the sleeve portion. At the same time, an application of the applicator unit on the applicator support body over the contact face is ensured.

A cosmetic unit with a. a housing b. an applicator unit according to any one of the preceding claims arranged, at least in portions, within the housing, and a cosmetic pencil comprising a cap to cover a region of the applicator unit, which projects on the housing, in particular of the applicator, wherein the applicator unit is pressed by means of a spring element with the applicator against a cosmetic product stored in the cap have the advantages of the applicator unit according to the invention, to which reference is hereby made.

Embodiments of the invention will be described in more detail below with the aid of the drawings

DESCRIPTION OF THE PREFERRED EMBODIMENTS

Figure 1:
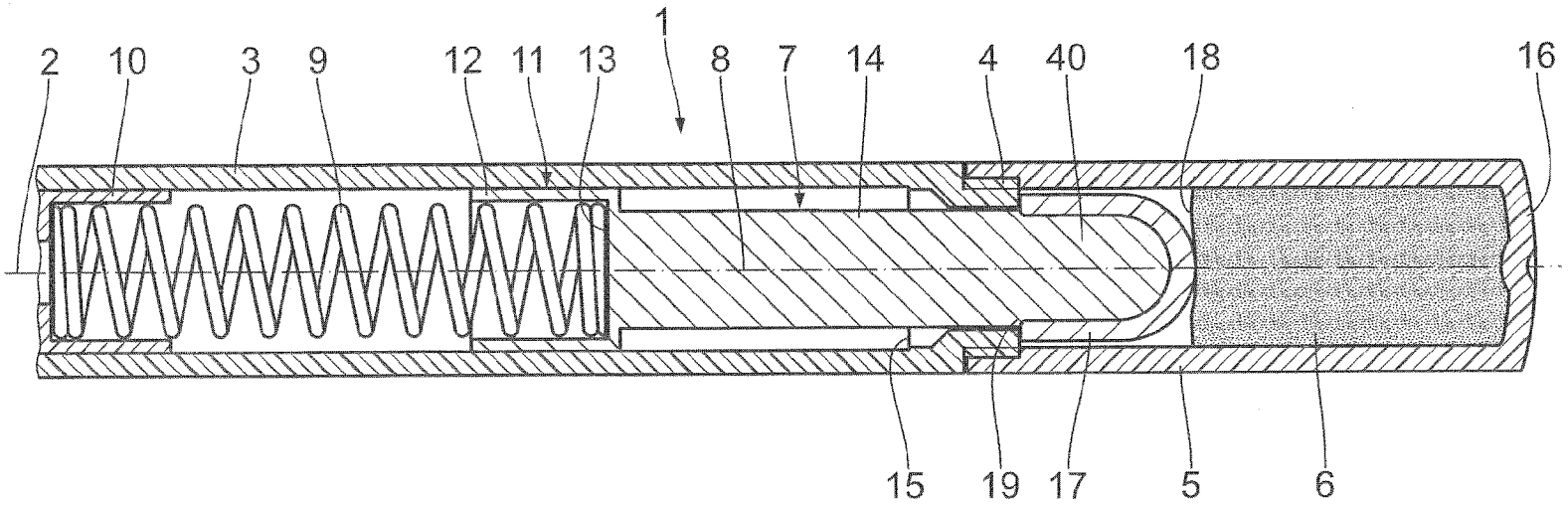
FIG. 1 shows a detailed view of a longitudinal section through a cosmetic unit with an applicator unit according to the invention.

A cosmetic unit shown partially in FIG. 1 is configured as a cosmetic pencil 1 and comprises a housing 3 having a housing longitudinal axis 2. The housing 3 is configured as a sleeve and closed at one end, shown on the right in FIG. 1, with a cap 5 screwed on by means of an internal thread 4. A supply of a cosmetic product 6 is provided in the cap 5. The cosmetic product 6 is provided in a pasty and/or powdery mass.

An applicator unit 7 with an applicator longitudinal axis 8 is arranged concentrically with respect to the housing longitudinal axis 2 in the housing 3. The applicator unit 7 can be displaced along the housing longitudinal axis 2 in the housing 3. For this purpose, a compression spring 9, shown on the left in FIG. 1 is provided, which is supported on an, in particular, screwed-in receiver 10 in the axial direction along the housing longitudinal axis 2.

The applicator unit 7 has a bowl-shaped stop element 11. The stop element 11 comprises a hollow sleeve portion 12, which is arranged concentrically with respect to the applicator longitudinal axis 8. The sleeve portion 12 is connected in one piece to the contact face 13. The contact face 13 is oriented perpendicular to the applicator longitudinal axis 8 and is used as a contact device for the compression spring 9. By means of the contact face 13 of the stop element 11 it is possible to exert a compressive force exerted by the compression spring 9 on the applicator unit 7 along the housing longitudinal axis 2 in the direction of the cap 5. The sleeve portion 12 of the stop element 11 has a cross-sectional shape oriented perpendicular to the applicator longitudinal axis 8 with an inner round cross-section and an outer quadratic cross-section. The stop element 11 thus has an outer non-round cross-sectional shape. The non-round cross-sectional shape is ensured in that an outer lateral surface of the stop element 11 has angular contour. Accordingly the housing 3 has an internal contour corresponding to the external contour of the stop element 11. In the region of this non-round internal contour of the housing 3, the stop element 11, along the housing longitudinal axis 2, is not rotatable about this housing longitudinal axis 2 and displaceable in a guided manner.

The axial displaceability of the applicator unit 7 is fixed by a contact shoulder 15 on an inside of the housing 3. In particular, the contact shoulder 15 is arranged in the housing 3 in such a way that the applicator unit 7, when the latter rests with the stop element 11 on the contact shoulder 15, rests on an outer face 16 of the cap 5. This means that it is ensured that even with increasing use of the cosmetic pencil 1 i.e. when the cosmetic product 6 is increasingly emptied, the applicator unit 7 is reliably pressed by the compression spring 9 against the cosmetic product. The applicator unit 7 with the applicator 17 is pressed by the compression spring 9 against a surface 18 of the supply of cosmetic product 6 arranged in the cap 5. When the cap 5 is unscrewed from the housing 3, the cosmetic product 6 is taken off by an applicator 17. The cosmetic product 6 can then be applied directly by means of the applicator 17.

An applicator support body 14 adjoins the stop element 11 along the applicator longitudinal axis 8. The applicator support body 14 is also called a spring bolt. The applicator support body 14 has a full cross-section and the contact face 13 correspondingly has a full surface area. The applicator support body 14 is made of plastics material, in particular of polyethylene (PE) and an elastomer. In particular, the plastics material has a hardness of at most 80 Shore D, in particular of at most 60 Shore D and, in particular of at most 40 Shore D. According to the embodiment shown, the applicator carrier is made of an elastomeric polyester block polymer, in the form of a thermoplastic polyester elastomer (TPC-ET). The thermoplastic polyester elastomer used to produce the applicator support body 14 is, for example, known by the trademark Hytrel or by the commercial name Lomod or Riteflex. This material has polyether soft segments, which ensure the resilience and flexibility of the applicator support body 14. The TPC-ET may be mixed with the polyethylene. It is also possible, instead of the polyethylene or in addition to the polyethylene, to use polypropylene (PP). The resilience of the applicator unit 7 as a whole is thus improved. The resilience of the applicator support body 14 can advantageously influence the total resilience of the applicator unit 7. In particular, it is possible to heterogeneously adjust the resilience of the applicator unit 7 so that, for example, the applicator support body 14 and an applicator head 40 have different resiliencies. This is, in particular, advantageously possible when the applicator unit 7 is produced by 2-component injection molding. The applicator support body 14 is substantially cylindrical.

The applicator 17 for applying the cosmetic product 6 is provided on an end of the applicator support body 14 arranged opposing the stop element 11 in the region of an applicator head 40. According to the embodiment shown, the applicator 17 has a coating in the form of a flocking. The flocking layer comprises fibres made of polyamide, in particular of PA 6.6.

The fibres used have a fiber length of 1.0 mm. The flocking layer has a flock thickness of at least 3.3 dtex. The unit dtex for the flock thickness gives the mass in grams of a fiber of 10000 m in length.

The applicator unit 7 according to the first embodiment in FIG. 1 has a substantially cylindrical applicator 17, which, in the region of a transition to the applicator support body 14, has an undercut 19. The applicator 17 has a curvature in a front area facing the cosmetic product 6.

The contour of the applicator 17 substantially corresponds to the contour of the applicator head 40, in other words, that of the material of the applicator support body 14 located therebelow. The flocking of the applicator 17 has a constant layer thickness. Depending on the purpose of application of the applicator, it is conceivable to provide a layer thickness, which is variable along the contour of the applicator 17, for the flocking, in order, for example, to variably adjust the hardness of the applicator 17.

The applicator unit 7 may be used in various embodiments of cosmetic pencils. It is, for example, possible, to use the applicator unit 7 in a cosmetic pencil known from DE 202 04 670 U1, in which two different cosmetic devices are combined with one another, in particular a lipstick and an applicator unit for the flat and/or linear application of eye cosmetics or the like. Moreover, it is also possible to use the applicator unit 7 in a cosmetic pencil known from DE 296 08 964 U1, which combines two identical applicator units in one cosmetic pencil.

Figure 2:
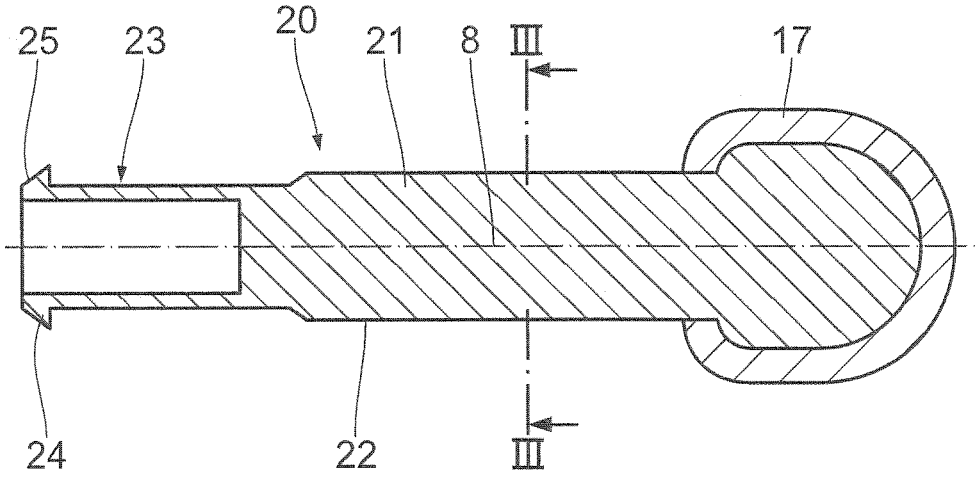
FIG. 2 shows an enlarged sectional view of an applicator unit according to a further embodiment.
Figure 3:
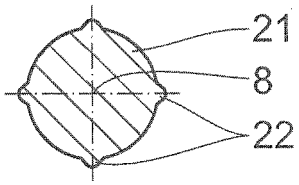
FIG. 3 shows a section along the line 111-111 in FIG. 2, FIG. 4 to FIG. 7 show further embodiments of an applicator unit.

FIGS. 2 and 3 show an enlarged sectional view of an applicator unit 20 according to a further embodiment. Components, which correspond to those, which have been described above with reference to FIG. 1, have the same reference numerals and will not be discussed again in detail.

The applicator unit 20 differs from the applicator unit 7 substantially in that a rotation about the housing longitudinal axis 2 is prevented in the housing 3, on the one hand, and a guidance of a displacement of the applicator unit 20 along the housing longitudinal axis 2 is ensured by means of four guide webs 22 arranged along the outer periphery of the applicator support body 21.

The applicator 17 of the applicator unit 20 is substantially identical to that according to the first embodiment. In particular, the flocking is identical. The stop element 23 has a radially projecting collar 24, in relation to the applicator longitudinal axis 8, tapering conically with respect to the end of the stop element 23. The collar 24 is formed in such a way that the applicator unit 20 can be inserted from the front into a cosmetic pencil, a contact shoulder, which cooperates in a latching manner with the collar 24 in such away that the applicator unit 20 is held in the cosmetic pencil, being provided on an inside of the housing. On insertion of the applicator unit 20, a deformation of the collar 24 is made possible to such an extent that the collar can be inserted by way of an introduction bevel 25 on the contact shoulder 15.

FIG. 4 to FIG. 7 show, in a view similar to FIG. 2, further embodiments of applicator units. Components, which correspond to those, which have been described above with reference to FIGS. 1 to 3, have the same reference numerals and will not be discussed again in detail.

Figure 4:
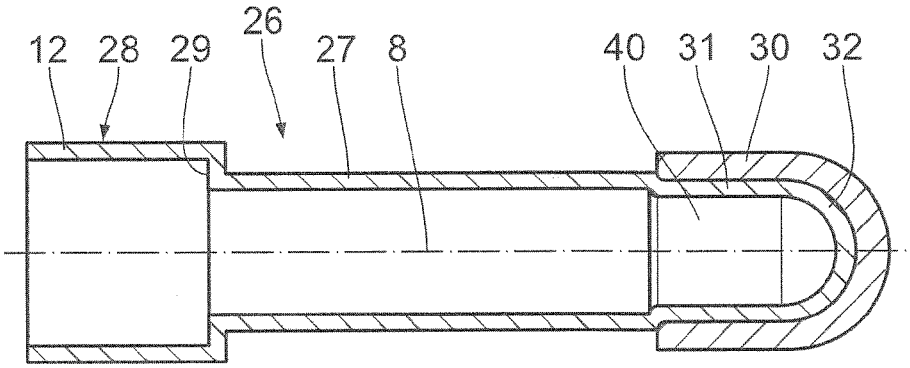

The applicator unit 26 according to FIG. 4 has a substantially sleeve-like applicator support body 27. This means that the applicator support body 27 has an open sleeve portion, which has an annular cross-sectional face perpendicular to the applicator longitudinal axis 8. An external diameter of the ring is smaller than an external contour of the sleeve portion 12 of the stop element 28. The stop element 28 is substantially identical to the stop element 11 according to the first embodiment, in other words with a non-round external contour of cross-sectional shape perpendicular to the applicator longitudinal axis 8, which has a round internal contour. As the applicator support body 27 is hollow, the contact face 29 is annular.

In the region of the applicator 30, the applicator head 40 is configured with a cylinder portion 31 and a semi-circular portion 32 terminating the cylinder portion 31. The shape of the applicator 30 is produced in accordance with the contour of the applicator head 40.

Figure 5:
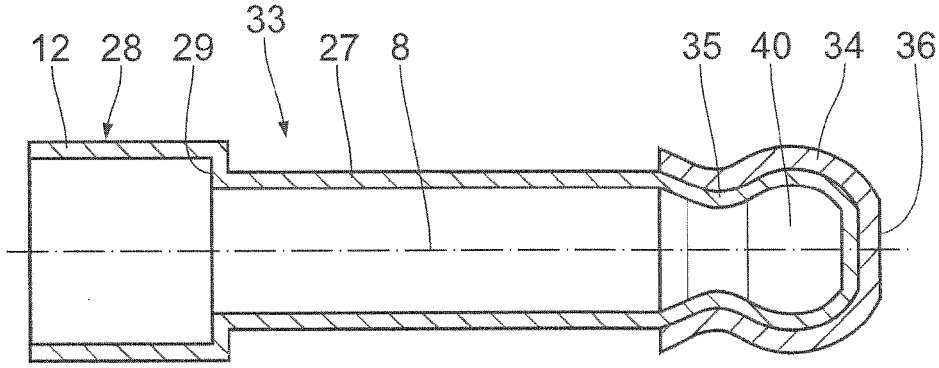

The applicator unit 33 according to FIG. 5 differs from the applicator unit 26 substantially by the design of the applicator head 40 or the applicator 34. The applicator 34 has a waisted pin shape with a concave contour region 35. The peripheral concave contour region 35 forms the waist of the pin. In a front region facing the surface 18 in the cosmetic pencil, the applicator 34 is flattened and has a level end face 36. The applicator 34 is, in particular, provided and suitable for large-area application, i.e. to produce wide strokes and lines with the cosmetic product. The end face 36 is round and has a diameter according to the embodiment shown of 2.22 mm. It is also possible to configure the end face 36 in a different basic shape, in particular to be four-sided. The size of the level end face 36 may be configured differently depending on the requirement of the application. Because of the complex shape of the applicator 34 in comparison to the applicator 30, the polyamide fibres used for the flocking are provided with a reduced length of 0.7 mm. The flock density is 1.7 dtex.

Figure 6:
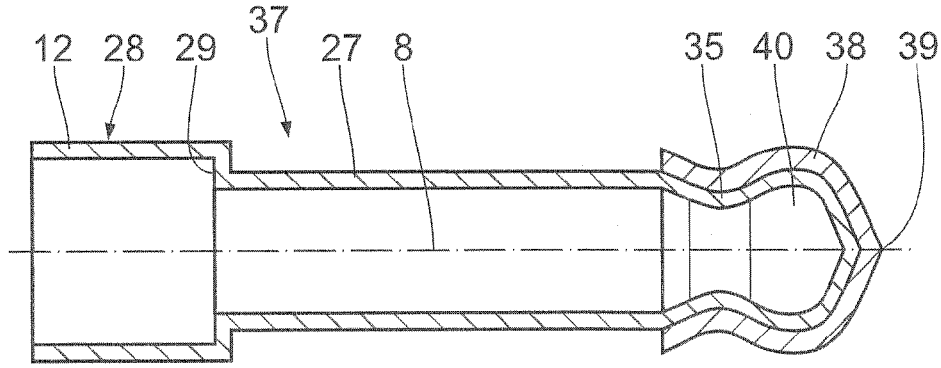

The applicator unit 37 shown in FIG. 6 is configured substantially similarly to the applicator unit 33 according to FIG. 5. One difference is the configuration of the applicator 38, which also has a concave contour region 35; however, the applicator 38 has a tapering contour region at a front side facing the surface 18, with a tip 39. The tip 39 rests on the applicator longitudinal axis 8. The applicator 38, for example, allows an application of very thin lines with a stroke thickness of about at most 1.0 mm, in particular at most 0.5 mm. The flocking of the applicator 38 is configured identically to that of the applicator 34.

Figure 7:
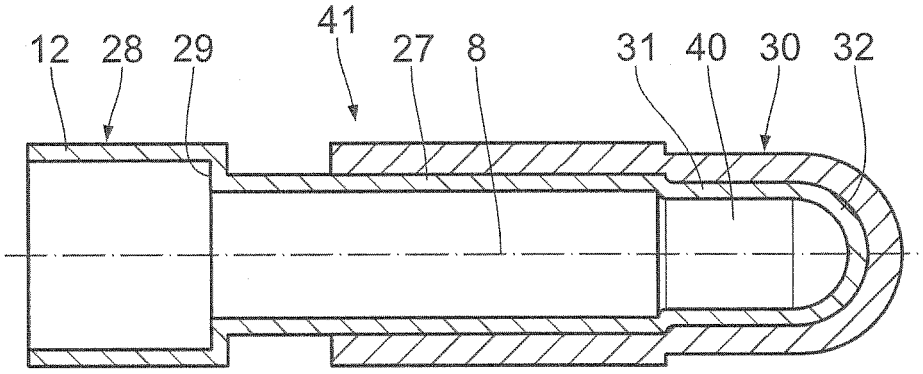

The applicator unit 41 according to FIG. 7 substantially corresponds to the applicator unit 26 according to FIG. 4. The important difference here is that the coating is also provided in the region of the applicator support body 21. This means that the coating is provided both in the region of the applicator head 40 and in the region of the applicator support body 21. In the embodiment shown in FIG. 7, an end of the applicator support body 21 facing the stop element 28 is uncoated. It is also conceivable for the applicator support body 21 along the applicator longitudinal axis 8 to have a coating over its entire length, in other words no uncoated portion.

It is obviously possible, in the further embodiments of an applicator unit, apart from the applicator head 40, to also provide the applicator support body 21, at least in portions, with a coating.

In particular, the coating is such that an external diameter of the coating, in particular in the region of the applicator support body 21, is smaller than an external diameter of the stop element 28, which is used for the longitudinal guidance and to prevent the rotation of the applicator unit 41.

The applicator unit 41 allows a combined application of the cosmetic product. For example, it is possible, by means of the coating in the region of the applicator head 40, to apply the cosmetic product over a large area, in particular to eyelids and/or in the region of the cheeks. The applicator may also be configured to apply thin lines, such as, for example, for an eyeliner, in the region of the applicator head 40. Furthermore, the coating in the region of the applicator support body 21 allows the application of mascara on eyelashes. In particular, it is conceivable for the coating to be configured differently because of the different application regions on the applicator head 40 and on the applicator support body 21. This can, for example, be achieved by the use of different flockings. In particular, the coating is configured in a brush form by the coating in the region of the applicator support body 21, in other words with a comparatively small flock thickness of, for example, less than 1.0 dtex. In particular, the fibres used for the brush region have a comparatively large fiber length of more than 2 mm.

Figure 8:
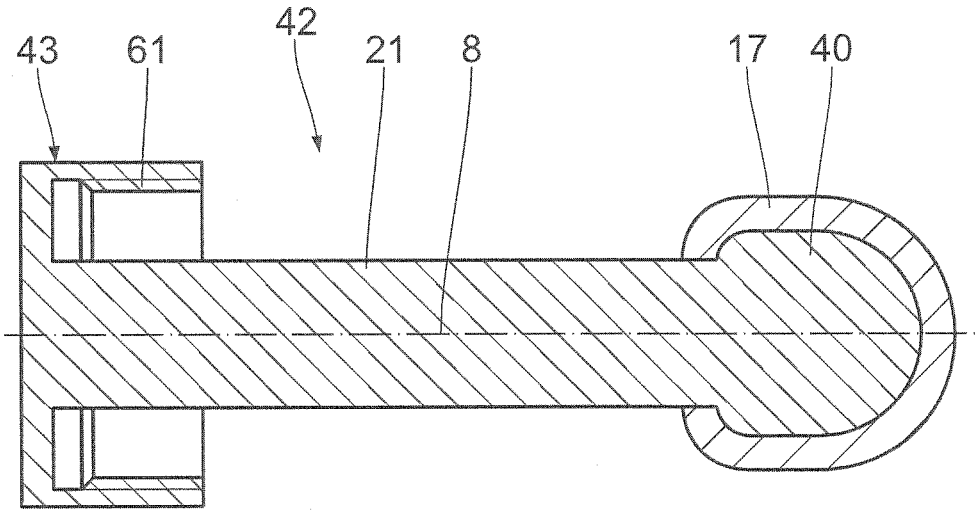
FIG. 8 shows a further embodiment of an applicator unit, which is configured in one piece with a closure cap of a cosmetic unit.

FIG. 8 shows a further configuration of an applicator unit. Components, which correspond to those, which have been described above with reference to FIGS. 1 to 7, have the same reference numerals and will not be discussed again in detail.

The applicator unit 42 differs from the previous embodiments in that no stop element is provided.

A connecting element 43 is formed in one piece on the applicator support body 21 on an end opposing the applicator head 40. According to the embodiment shown, the connecting element 43 is a closure cap with an internal thread 61, with which the closure cap 43 can be screwed onto a container, not shown. In a container of this type, for example, a cosmetic product may be stored, in which the applicator 17 is dipped. The cosmetic product may be stored in the container in a liquid, solid, pasty or powdery form. The applicator unit 42 does not serve for use in a cosmetic pencil according to FIG. 1.

The applicator support body 21 may also be flocked in the configuration according to FIG. 8, as already explained above in conjunction with FIG. 7.

The connecting element 43 can also be connected to the container in a different manner. For example, it is conceivable for the connecting element to latch onto the container in a manner known per se and for it to be removed correspondingly.

Figure 9:
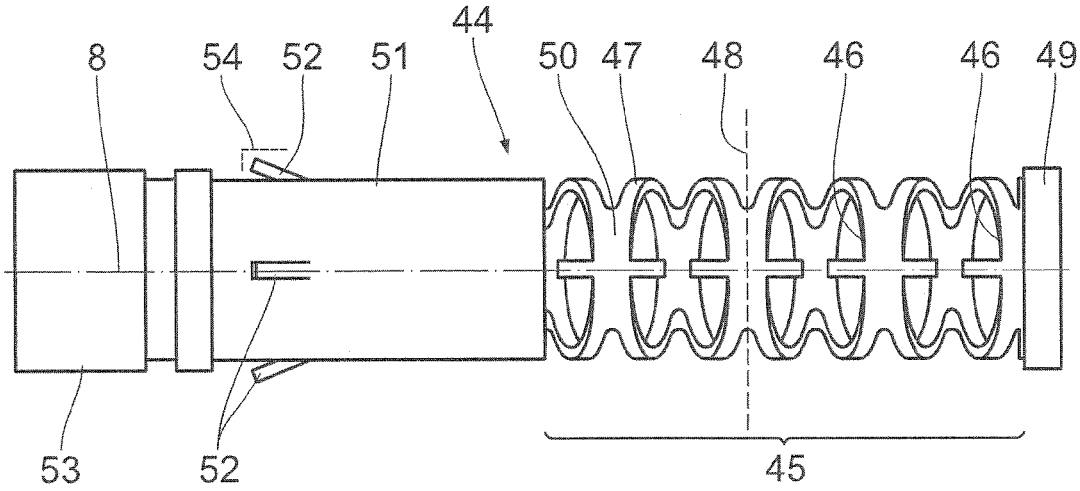
FIG. 9 shows a side view of a further embodiment of an applicator unit with an elastically resilient applicator.

FIG. 9 shows a further configuration of an applicator unit. Components, which correspond to those, which have been described above with reference to FIGS. 1 to 8, have the same reference numerals and will not be discussed again in detail.

The applicator unit 44 differs from the previous embodiments in that it is configured elastically resiliently at least in portions along the applicator longitudinal axis 8. The applicator unit 44 has a resilient sleeve portion 45. The resilient sleeve portion 45 has a plurality, a total of seven in the configuration shown in FIG. 9, of ring elements 47, which are spaced apart from one another by spring intermediate spaces 46 and are elastically displaceable relative to one another. When the resilient sleeve portion 45 is flexed, adjacent ring elements 47 pivot about fixed joint axes 48, which are predetermined by the forming-on portions of two adjacent ring elements 47.

The applicator unit 44 has an annular terminating band 49 for abutment, in particular on a cover face of a cap.

The resilient sleeve portion 45 forms the applicator to apply a cosmetic product. In particular, the cosmetic product is received peripherally on the resilient sleeve portion 45 and then applied. For this purpose, a respective width of the ring elements 47 and an extent of the spring intermediate spaces 46 are dimensioned such that the cosmetic product is provided on an outside 50 of the ring elements 47. The width of the ring elements 47 along the applicator longitudinal axis 8 is, in particular, greater than the extent of the spring intermediate spaces 46 along the applicator longitudinal axis 8. There applies, in particular, that the width of the ring elements 47 is at least 1.5 times and, in particular, at least twice, the extent of the spring intermediate spaces 46.

The resilient sleeve portion 45 is configured in one piece with the applicator support body 51. A plurality of in the embodiment shown, three, hook elements 52 can be provided on the applicator support body 51. The hook elements 52 are formed in one piece on the applicator support body 51. The three hook elements 52 are arranged distributed equally about the applicator longitudinal axis 8 in the peripheral direction. Free ends of the hook elements 52 project oriented obliquely with respect to the stop element 53 from the applicator support body 51. When the applicator unit 44 is assembled in a cosmetic pencil 1, the hook elements 52 engage behind a peripheral step 54 indicated by dashed lines in Ha. 9 in the inner wall of the housing 3, which faces the applicator unit 44, of the cosmetic pencil 1. The hook elements 52 are used to secure the applicator unit 44 in the housing 3 of the cosmetic pencil.

The applicator according to the embodiment in FIG. 9, has no coating. It is possible for the applicator to be configured with a coating, in particular in the form of a flocking, as in the embodiments described above.

The resilient sleeve portion 45, along the applicator longitudinal axis 8, has good resilience. The loading of the applicator in the housing 3 and/or the cap 5 of the cosmetic pencil 1 is thereby made possible. At the same time, the application of the cosmetic product is made possible. The applicator unit 44 is produced from plastics material and has, in particular, polyethylene and an elastomer, in particular, an elastomeric polyester block polymer, in particular a thermoplastic polyester elastomer (TPC-ET).

Figure 10:
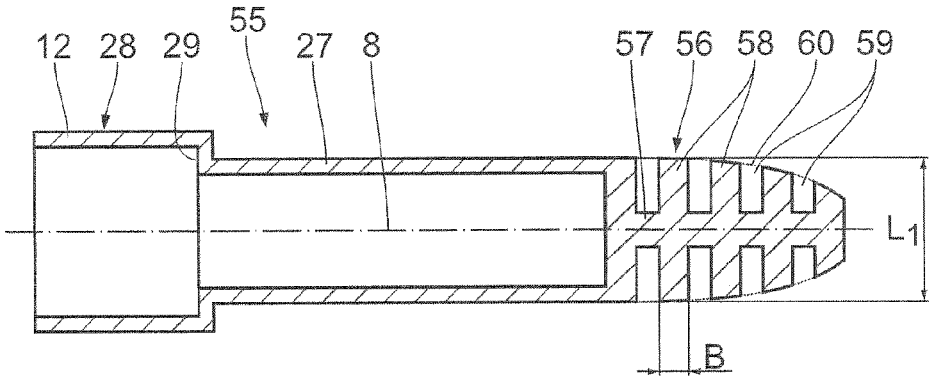
FIG. 10 shows a view corresponding to FIG. 4 of a further embodiment of an applicator unit with an elastically resilient applicator.
Figure 11:
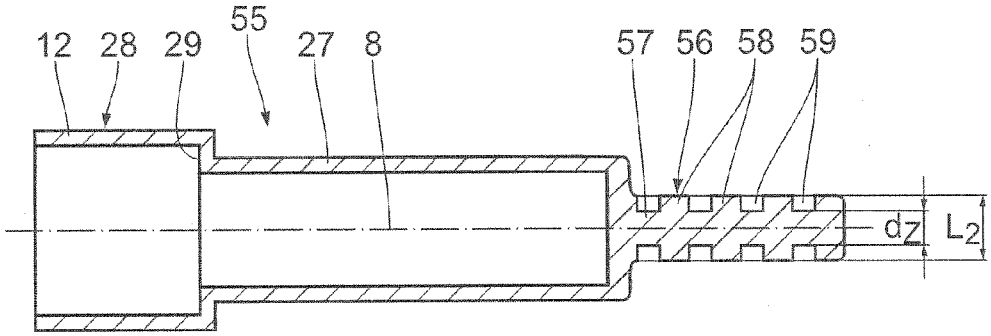
FIG. 11 shows a sectional view of the applicator unit according to FIG. 10 rotated through 90° with respect to the applicator longitudinal axis.

FIGS. 10 and 11 show a further configuration of an applicator unit. Components, which correspond to those, which have been described above with reference to FIGS. 1 to 9, have the same reference numerals and will not be discussed again in detail.

The applicator unit 55 differs from the previous embodiments by the configuration of the applicator with an elastically resilient structure. The applicator 56 is configured substantially in the form of a fir tree along the applicator longitudinal axis 8. The applicator 56 has a central cylinder web 57 arranged concentrically with respect to the applicator longitudinal axis 8. The cylinder web 57 has a diameter $d_z$. A plurality of according to the embodiment shown, four, radial elements 58 extend on both sides of the web 57 radially with respect to the applicator longitudinal axis 8. The radial elements 58 are formed in one piece on the web 57. The radial elements 58 have a width B oriented along the applicator longitudinal axis 8. According to the embodiment shown, the width B for the individual radial elements 58 is identical. To improve the application of the cosmetic product and/or to load the applicator 56 and, in particular depending on the consistency of the cosmetic product, the width B of the radial elements 58 can vary. The radial elements 58 are arranged spaced apart from one another by intermediate spaces 59 along the applicator longitudinal axis 8. The radial elements 58 have a substantially rectangular cross-sectional face oriented perpendicular to the applicator longitudinal axis 8 with a first length $L_1$ shown in FIG. 10 and a second length $L_2$ shown in FIG. 11.

According to the embodiment shown, the first length $L_1$ is greater than the second length for each of the radial elements 58. There applies, in particular, $L_1 \geq 1.5 \times L_2$, in particular $L_1 \geq 2.0 \times L_2$, and in particular $L_1 \geq 3.0 \times L_2$. In a configuration not shown, the lengths $L_1$ and $L_2$ can also be the same size. In particular, the applicator 56 may in total be rotationally symmetrical about the longitudinal axis 8. The first length $L_1$ for the radial elements 58 is variable along the applicator longitudinal axis 8. A first radial element 58, which is shown on the left in FIG. 10 and faces the applicator support body 27, has a maximum first length. A fourth radial element, which is shown on the right in FIG. 10 and is maximally spaced apart from the applicator support body 27, has a minimum first length $L_1$. The first lengths $L_1$ of the radial elements 58 provide a substantially curved contour 60, shown by dashed lines in FIG. 10. It is also possible for the contour to be linear, i.e. a surface formed thereby to be formed conically.

The second lengths $L_2$ along the applicator longitudinal axis 8 are substantially the same size.

The applicator 56, because of the configuration with the radial elements 58 and the intermediate spaces 59 arranged in between, has an improved structural resilience. In particular, it is possible for the applicator 56 to be bent about the applicator longitudinal axis 8. The flexibility can be influenced by the design of the first length $L_1$ and the second length $L_2$ of the respective radial elements 58. In general, it applies that the applicator 56 is all the more rigid, the larger the first or the second length is selected to be. This means that the applicator 56 in a direction perpendicular to the applicator longitudinal axis 8 in FIG. 11, has a greater resilience and flexibility than in a direction perpendicular to the applicator longitudinal axis 8 in FIG. 10. The applicator 56, in accordance with the previous embodiments, may have a coating in the form of a flocking.

Basically, with respect to the embodiments shown, there applies that any desired combinations of the individual features of the embodiments shown are also conceivable. In particular, it is possible for the applicator unit 55 shown in FIGS. 10 and 11 to be provided with a connecting element formed on in one piece, in the form of a closure cap instead of a stop element.

Figure 12:
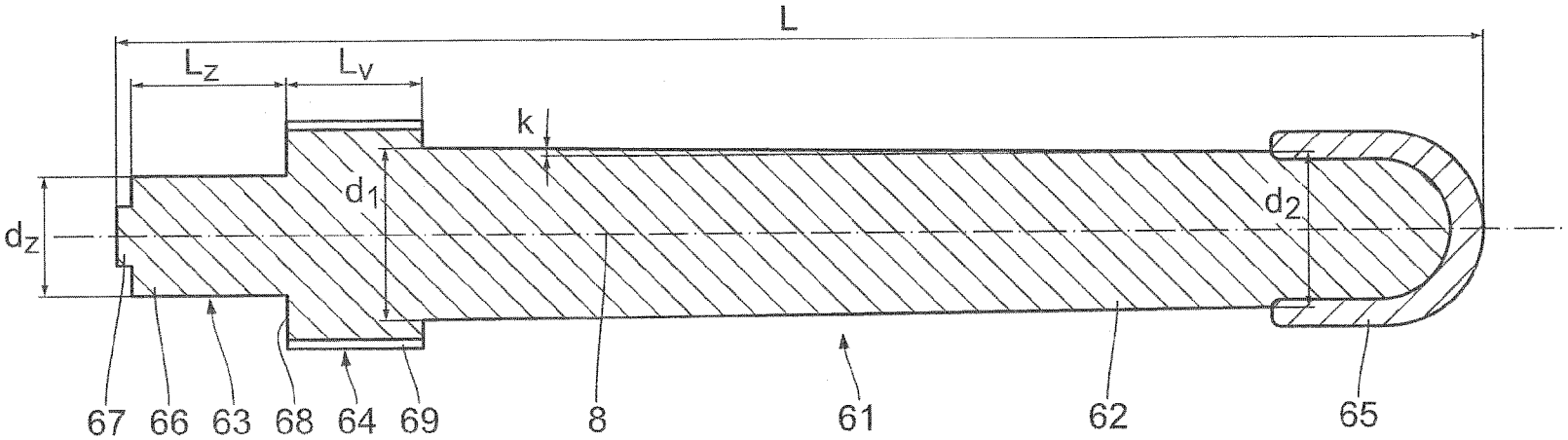
FIG. 12 shows a sectional view corresponding to FIG. 2 of a further embodiment of an applicator unit with a conical applicator support body along the line XII-XII in FIG. 13
Figure 13:
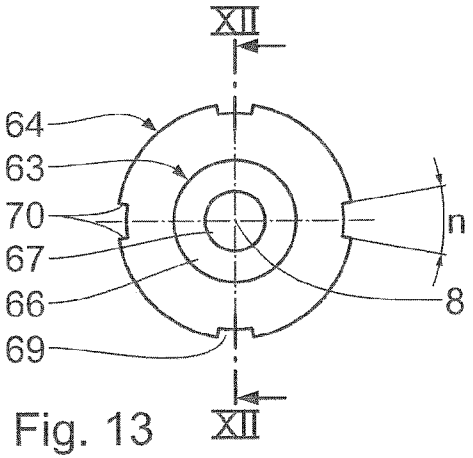
FIG. 13 shows a rear view of the applicator unit according to FIG. 12.

FIGS. 12 and 13 show a further embodiment of an applicator unit. Components, which correspond to those, which have been described above with reference to FIGS. 1 to 11, have the same reference numerals and will not be discussed again in detail.

The applicator unit 61 differs from the previous embodiments by the configuration of the applicator support body 62, the stop element 63 and the non-round cross-sectional shape as an anti-rotation device 64. Individual distinguishing features, or all of them, discussed below in more detail, can also be used in the applicator units described above with reference to FIGS. 1 to 11.

The applicator unit 61 and, in particular, the applicator support body 62 have a full cross-section perpendicular to the applicator longitudinal axis 8. Along the applicator longitudinal axis 8, the applicator support body 62 is configured to taper conically toward the applicator 65. At an end facing the anti-rotation device 64, a circular cross-sectional face of the applicator support body 62 has a first diameter $d_1$, which is greater than a second diameter $d_2$ of the applicator support body 62 at an end facing the applicator 65. According to the embodiment shown, the first diameter $d_1$ is 5.85 mm. The second diameter $d_2$ is 5.0 mm. Accordingly, a conicity angle k of about 0.85° is produced. The conicity of the applicator support body 62 is used for an improved, in particular facilitated, remolding of the applicator support body 62 after the injection molding production.

The flocking of the applicator 65 has a flock density of 3.3 dtex and fibres with a fiber length of 1.2 mm.

The stop element 63, in contrast to the embodiment described above, is not sleeve-like hut pin-like in configuration. For this purpose, the stop element 63 has a pin 66. The pin 66 is cylindrical with respect to the applicator longitudinal axis 8 and, at a free end, which is arranged opposing the anti-rotation device 64, has a sprue portion 67. The sprue portion 67 is used to inject a liquid plastics material melt during the injection molding process to produce the applicator support body 62. The diameter $d_z$ of the pin 66 is selected in such a way that a spring, which is used to apply a spring force to the applicator unit 61, can surround the pin. In particular, a spring of this type is configured as a helical spring, so the pin can enter an inner hollow region of the spring. The stop element 63 furthermore has an annular disc-shaped contact face 68 oriented perpendicular to the applicator longitudinal axis 8, as a shoulder. The contact face 68 is used to rest the spring on the stop element 63 in order to apply a spring force to the applicator unit 61. A length $L_z$ of the pin 66 along the applicator longitudinal axis 8 is dimensioned such that the spring is reliably guided on the stop element 63 to load the applicator unit 61 with a spring force. At the same time, the stop element 63 with the pin 66 ensures a secure and reliable guidance of the spring to apply a spring force to the applicator unit 61. In particular, the stop element 63 is stable.

Since the stop element 63 can be injected over the full surface via the central sprue portion 67, a remolding of the applicator support body 62 after the injection molding process is simplified. In particular, it is not necessary to separate the applicator support body 62 from an injection-molded piece after the injection molding process. It is possible to remove a large number of applicator support bodies 62, which are produced by the injection molding method and are connected to one another by a common injection-molded piece, from an injection-molding tool and to then flock the applicator support body 62 in a common working step. The production method, in particular the handling of the applicator support bodies 62 produced in the injection molding process and a subsequent flocking process of the applicator support bodies 62, are significantly simplified.

The anti-rotation device 64 is changed compared to the anti-rotation device shown in FIG. 3 in that guide webs are not provided, hut guide grooves 69. Four respectively identically configured guide grooves 69 arranged uniformly spaced along the periphery are provided along the outer periphery on the anti-rotation device 64. The guide grooves 69 are oriented parallel to the applicator longitudinal axis. The design of the geometry of the guide grooves 69, i.e. a groove width oriented substantially in the peripheral direction and a groove depth oriented substantially radially in relation to the applicator longitudinal axis 8 are selected in such a way that a reliable linear guidance of the applicator unit 61 is ensured in a cosmetic pencil. In particular, the guide grooves 69 of the anti-rotation device 64 correspond with guide webs on the cosmetic pencil. In order to additionally simplify the production and, in particular, the remolding of the injection-molded applicator support body 62, the groove flanks 70 may have a radially outwardly directed, increasing groove opening angle n. The groove opening angle n indicates an oblique position of the groove flanks 70. According to the embodiment shown, the groove opening angle is about 10°. The groove opening angle may also be more or less than 10°. A length $L_v$ of the anti-rotation device 64 along the applicator longitudinal axis 8 is reduced compared to the embodiments described above. The length $L_v$ is about 10% of the total length L of the applicator unit 61. There applies, in particular: $L_v \leq 0.2 \times L$, in particular $L_v \leq 0.15 \times L$ and in particular $L_v \leq 0.1 \times L$.

The described embodiments of an applicator unit are suitable to be used in a cosmetic unit partly shown in FIG. 1. A cosmetic unit of this type is, in particular, configured as a cosmetic pencil and can have a single applicator unit. It is also conceivable for the cosmetic pencil, at the two opposing ends, to, in each case, have an identical applicator unit or different ones at the opposing ends.

What is claimed is:

1. A cosmetic unit comprising:

a housing (3), an applicator unit for the cosmetic unit comprising:

a substantially cylindrical applicator support body (14; 21; 27; 27; 27; 21; 27; 51; 27; 62) with an applicator longitudinal axis (8), an applicator (17; 17; 30; 34; 38; 17; 30; 45; 56; 65) arranged on an applicator head (40) of the applicator support body (14; 21; 27; 27; 27; 21; 27; 51; 27; 62) for applying a cosmetic product (6), wherein the applicator unit (7; 20; 26; 33; 37; 41; 42; 44; 55; 61) is configured in one piece as an integrally produced product, wherein the applicator comprises at least one of a coating and a surface of the applicator head produced by two-component injection molding in one piece with the applicator support body, wherein the applicator support body (14; 21; 27; 27; 27; 21; 27; 51; 27; 62) is produced from plastics material which has a hardness of at most 80 Shore D, wherein said applicator unit is arranged, at least in portions, within the housing (3), and wherein the cosmetic unit comprises a spring element pressing the applicator unit with the applicator against a cosmetic product.

2. A cosmetic unit comprising;

a housing (3), an applicator unit for the cosmetic unit comprising:

a substantially cylindrical applicator support body (14; 21; 27; 27; 27; 21; 27; 51; 27; 62) with an applicator longitudinal axis (8), an applicator (17; 17; 30; 34; 38; 17; 30; 45; 56; 65) arranged on an applicator head (40) of the applicator support body (14; 21; 27; 27; 27; 21; 27; 51; 27; 62) for applying a cosmetic product (6), wherein the applicator unit (7; 20; 26; 33; 37; 41; 42; 44; 55; 61) is configured in one piece as an integrally produced product, wherein the applicator comprises at least one of a coating and a surface of the applicator head produced by two-component injection molding in one piece with the applicator support body, wherein the material of the applicator support body (14; 21; 27; 27; 27; 21; 27; 51; 27; 62) includes polyethylene and an elastomer, wherein said applicator unit is arranged, at least in portions, within the housing (3), and wherein the cosmetic unit comprises a spring element pressing the applicator unit with the applicator against a cosmetic product.

3. A cosmetic unit with a housing (3), an applicator unit (7; 20; 26; 33; 37; 41; 42; 44; 55; 61) comprising;

a substantially cylindrical applicator support body (14; 21; 27; 27; 27; 21; 27; 51; 27; 62) with an applicator longitudinal axis (8), an applicator (17; 17; 30; 34; 38; 17; 30; 45; 56; 65) arranged on an applicator head (40) of the applicator support body (14; 21; 27; 27; 27; 21; 27; 51; 27; 62) for applying a cosmetic product (6), wherein the applicator unit (7; 20; 26; 33; 37; 41; 42; 44; 55; 61) is configured in one piece as integrally produced product, wherein the applicator comprises a coating in the form of a flocking, wherein said applicator unit is arranged, at least in portions, within the housing (3), and wherein the cosmetic unit comprises a spring element pressing the applicator unit with the applicator against a cosmetic product.

4. The cosmetic unit according to claim 3, comprising a stop element (11; 23; 28; 28; 28; 28; 53; 11; 63) to apply a force to the applicator support body (14; 21; 27; 27; 27; 27; 51; 27; 62).

5. The cosmetic unit according to claim 4 comprising a cross-sectional shape, which is oriented perpendicular to the applicator longitudinal axis (8) and, at least in portions, is configured to be non-round, wherein the stop element (11; 23; 28; 28; 28; 28; 53; 11) has a non-round cross-sectional shape.

6. The cosmetic unit according to claim 4, wherein the stop element (11; 23; 28; 28; 28; 28; 53; 11) has a sleeve portion (12) and a contact face (13; 13; 19; 19; 19).

7. The cosmetic unit according to claim 3, wherein the applicator support body (14; 21; 27; 27; 27; 21; 27; 51; 27; 62) is produced from plastics material.

8. The cosmetic unit according to claim 3, wherein the applicator support body (14; 21; 27; 27; 27; 21; 27; 51; 27; 62) is produced from plastics material which has a hardness of at most 60 Shore D.

9. An applicator unit according to claim 3, wherein the applicator support body (14; 21; 27; 27; 27; 21; 27; 51; 27; 62) is produced from plastics material which has a hardness of at most 40 Shore D.

10. The cosmetic unit according to claim 3, wherein the material of the applicator support body (14; 21; 27; 27; 27; 21; 27; 51; 27; 62) includes an elastomeric polyester block polymer.

11. The cosmetic unit according to claim 3, wherein the material of the applicator support body (14; 21; 27; 27; 27; 21; 27; 51; 27; 62) includes a thermoplastic polyester elastomer (TPC-ET).

12. The cosmetic unit according to claim 3, wherein the applicator support body (4; 21; 27; 27; 27; 21; 27; 51; 27; 62) has a solid cross-section oriented perpendicular to the applicator longitudinal axis (8).

13. The cosmetic unit according to claim 3, wherein the applicator support body (4; 21; 27; 27; 27; 21; 27; 51; 27) has a hollow cross-section oriented perpendicular to the applicator longitudinal axis (8).

14. An applicator unit according to claim 3, wherein the coating has fibres made of polyamide.

15. The cosmetic unit according to claim 3, wherein the coating has fibres made of PA 6.6.

16. The cosmetic unit according to claim 3, wherein the coating has a flock thickness of at least 1.7 dtex.

17. The cosmetic unit according to claim 3, wherein the coating has a flock thickness of at least 3.3 dtex.

18. The cosmetic unit according to claim 3, wherein the coating has fibres with a fiber length of at least 0.5 mm.

19. The cosmetic unit according to claim 3, wherein the coating has fibres with a fiber length of at least 0.7 mm.

20. The cosmetic unit according to claim 3, wherein the coating has fibres with a fiber length of at least 1.0 mm.

21. The cosmetic unit according to claim 3, wherein the coating has fibres with a fiber length of at least 2.0 mm.

22. The cosmetic unit according to claim 3, wherein the coating has fibres with a fiber length of at least 1.5 mm.

23. The cosmetic unit according to claim 3, comprising a cross-sectional shape, which is oriented perpendicular to the applicator longitudinal axis (8) and, at least in portions, is configured to be non-round.

24. A cosmetic unit according to claim 3, comprising a cap (5) to cover a region of the applicator unit (7; 20; 26; 33; 37; 41; 42; 44; 55; 61), which projects on the housing (3), wherein the applicator unit (7; 20; 26; 33; 37; 41; 42; 44; 55; 61) is pressed by a spring element (9) with the applicator (17; 17; 30; 34; 38; 17; 30; 45; 56; 65) against a cosmetic product (6) stored in the cap (5).

25. A cosmetic unit according to claim 3, comprising a cap (5) to cover a region of the of the applicator (17; 17; 30; 34; 38; 17; 30; 45; 56; 65), which projects on the housing (3), wherein the applicator unit (7; 20; 26; 33; 37; 41; 42; 44; 55; 61) is pressed by a spring element (9) with the applicator (17; 17; 30; 34; 38; 17; 30; 45; 56; 65) against a cosmetic product (6) stored in the cap (5).

* * * * *